United States Patent [19]

Endo et al.

[11] Patent Number: 4,705,482

[45] Date of Patent: Nov. 10, 1987

[54] TERMINAL CONNECTOR ASSEMBLY FOR MULTICONDUCTOR CABLE

[75] Inventors: Seiji Endo; Eiji Kikuchi, both of Tochigi, Japan

[73] Assignee: Sumitomo Electric Industries, Ltd., Osaka, Japan

[21] Appl. No.: 816,618

[22] Filed: Jan. 6, 1986

[30] Foreign Application Priority Data

Jan. 11, 1985 [JP] Japan ..... 60-2604[U]
Jan. 14, 1985 [JP] Japan ..... 60-4483

[51] Int. Cl.[4] ..... H01R 9/07; H01R 13/58

[52] U.S. Cl. ..... 439/460; 439/467; 439/492

[58] Field of Search ..... 339/17 F, 176 MF, 103 M, 339/75 MP

[56] References Cited

U.S. PATENT DOCUMENTS 3,989,336 11/1976 Rizzio et al. ..... 339/75 MP X
4,449,773 5/1984 Esser et al. ..... 339/176 MF X
4,573,752 3/1986 Rich ..... 339/17 F

*Primary Examiner*—Eugene F. Desmond

*Attorney, Agent, or Firm*—Cushman, Darby & Cushman

[57] ABSTRACT

A terminal connector assembly for removably receiving end portions of a multiconductor cable includes a terminal block defining an array of interior elongate cavities. Each cavity is provided with a generally U-shaped terminal member having a pair of opposing spaced-apart side arms and an integral pair of opposing protruding contact portions. The protruding contact portions establish therebetween an entranceway of reduced cross-sectional dimension such that upon insertion of an end portion of the multiconductor cable therebetween, the contact portions establish electrical contact therewith. A housing cover is also disclosed whereby peninsular portions thereof are capable of resilient displacement so as to release gripping engagement with the multiconductor cable to permit withdrawal thereof while yet being resiliently biased into gripped engagement with the multiconductor cable when the latter is inserted into the terminal connector assembly so as to assist in maintaining electrical contact between the multiconductor cable and the protruding contact portions of the U-shaped terminal member.

10 Claims, 10 Drawing Figures

TERMINAL CONNECTOR ASSEMBLY FOR MULTICONDUCTOR CABLE

This application is based upon Japan Application Nos. 60-2604 filed Jan. 11, 1985 and 60-4483 filed Jan. 14, 1985, the entire disclosure of each being expressly incorporated hereinto by reference.

FIELD OF THE INVENTION

The present invention generally relates to a terminal connector assembly for removably receiving end portions of a multicore or multiconductor flat cable typically utilized in electronic machinery and apparatus. More particularly, the present invention relates to a terminal connector assembly and a cover housing therefor in which a generally U-shaped terminal member includes a pair of opposing spaced-apart side arms to define a pair of inwardly protruding contact portions. The terminal connector assembly of the present invention is thus well suited for being manufactured in a compact size without deleteriously affecting its functional operability and thus maintaining higher reliability as compared to conventional connectors.

BACKGROUND OF THE INVENTION

Conventionally, terminal connectors are used which are fabricated so that a conductor exposed by stripping an end of a multicore or multiconductor flat cable can be inserted thereinto so as to establish electrical communication between the cable (and thus the components to which the cable is attached) and a substrate member (for example, a printed circuit board or the like).

One conventional terminal connector assembly 10 is shown in cross-section in accompanying FIG. 1. As can be seen, a terminal connector 12 is housed within terminal block 14. Terminal connector 12 includes a contact point 16 which is biased into electrical contact with the exposed end 18 of multiconductor cable 20. The terminal connector 12 at its end opposite to contact point 16 passes through housing 14 via aperture 22 and is soldered at solder connection 24 to substrate 26. Since the terminal connector 12 passes through the housing 14, it is thus susceptible of being contaminated with fluxing agents typically used during soldering of connector terminal 12 to the substrate 26. That is, fluxing agents may gain entry into cavity 28 of housing 14 via a clearance between the terminal connector 12 and aperture 22 thereby resulting in poor electrical contact when the fluxing agent reaches the contact point 16. Penetration of the fluxing agent into housing 2 thus represents a potential fatal defect to the conventional connector assembly 10 shown in FIG. 1 since there is only a single contact point 16 to establish electrical contact with exposed end 18 of multiconductor cable 20.

Moreover, the cable 20 is mechanically held via bias spring pressure at the contact point 16 of terminal connector 12 so that the cable 20 is readily removed from the connector assembly 10 when the spring pressure of terminal connector 12 is decreased thereby resulting in poor electrical contact witn exposed end 18 at contact point 16. Thus, should the connector assembly 10 of FIG. 1 be reduced in size, the connector terminal 12 is also inevitably reduced in size thereby necessarily decreasing the spring force exerted by terminal connector 12 at contact point 16. This mitigates against reduced terminal connector sizes since disconnection of the multiconductor cable could occur.

One object of the present invention therefore is to provide a terminal connector in an assembly whose configuration affords sufficient mechanical holding strength under lower spring pressures which thereby promotes size reduction of the overall connector assembly without jeopardizing its reliability for establishing electrical contact with the exposed ends of the multiconductor cable. Another object of the invention is to provide a small-sized, compact and highly reliable connector assembly which eliminates the aperture necessary in conventional connector assemblies so as to prevent the potential of fluxing agents being introduced within the terminal block thereby promoting reliable electrical contact between the terminal connector and the exposed ends of the multiconductor cable.

These objects are achieved, generally, by a terminal connector assembly which removably receives end portions of the multiconductor cable to thereby establish electrical communication between the cable and the substrate member (for example, a printed circuit board) by providing a terminal block which defines an array of interior elongate cavities each having an open upper end. Each cavity includes a generally U-shaped terminal member having a pair of opposing spaced-apart side arms and a bridge portion integrally connecting the pair of side arms such that the side arms extend upwardly to the open upper end of the terminal block to permit a respective one of the cable end portions to be insertably received therebetween. The pair of arms also integrally includes an opposing pair of inwardly protruding contact portions which establish therebetween an entranceway of reduced cross-sectional dimension. The pair of contact portions thus ensure sufficient electrical contact between the U-shaped terminal connector and the inserted end of the multiconductor cable such that electrical contact therebetween is ensured to thus promote increased reliability of the terminal connector.

Preferably, the connector assembly of the present invention includes a housing cover having plural apertures formed in registry with the array of terminal cavities and the means for permitting resilient displacement of at least one section of each aperture relative to another section thereof. In such a manner, the one section is resiliently displaceable between gripping and release positions so as to respectively grip the multiconductor cable (thereby retaining the end portions in electrical contact with the contact portions of the U-shaped terminals) and permitting the end portions of the multiconductor cable to be removed therefrom.

The above as well as other objects and advantages of this invention will be better understood after careful consideration is given to the detailed description of the preferred exemplary embodiments thereof which follows.

BRIEF DESCRIPTION OF THE ACCOMPANYING DRAWINGS

Reference will be hereinafter made to the accompanying drawings wherein like reference numerals throughout the various figures denote like structural elements and wherein.

DETAILED DESCRIPTION OF THE PREFERRED EXEMPLARY EMBODIMENTS

Figure 2:
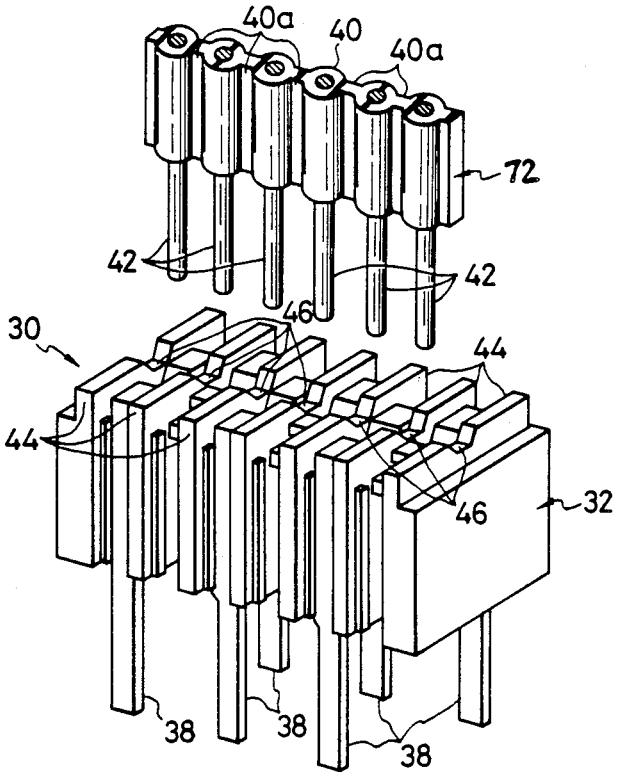
FIG. 2 is a perspective view of a terminal connector assembly in accordance with one embodiment of the present invention.

FIG. 2 depicts a terminal connector assembly 30 of the present invention and a conventional multiconductor cable 72 shown as being withdrawn therefrom. Terminal connector assembly 30 includes a terminal block 32 defining a linear array of open-ended interior cavities 34 (a representative cavity 34 is shown in accompanying FIG. 3). Generally U-shaped terminals 36 are housed within each interior cavity 34 each of which includes a tail portion 38 extending along and beyond a lateral side of terminal block 32 so as to be solderable to a substrate (not shown), such as a printed circuit board or the like. U-shaped terminals 36 are positioned in their respective cavities 34 such that the tail portions 38 alternately extend below a respective side of terminal block 32 relative to adjacent ones of terminals 36. That is, the tail portions 38 of each U-shaped terminal 36 are staggered relative to the direction of the linear array of cavities 34 (see FIG. 2).

As is conventional, multiconductor cable 72 is prepared for electrical contact with U-shaped terminals 36 by removing a portion of the insulation 40 therefrom so as to expose ends 42. The multiconductor cable 72 is thus a plurality of conductive wires positioned parallel to one another by means of an interconnected web of insulation 40*a*. Terminal block 32 thus facilitates the positioning of multiconductor cable 72 by providing partition walls 44 each having a recess 46 in alignment with the linear array of cavities 34. Recesses 46 thus receive portions 40*a* of the insulation 40 to permit the exposed ends 42 to be better accepted within their respective U-shaped terminals 36.

Figure 3:
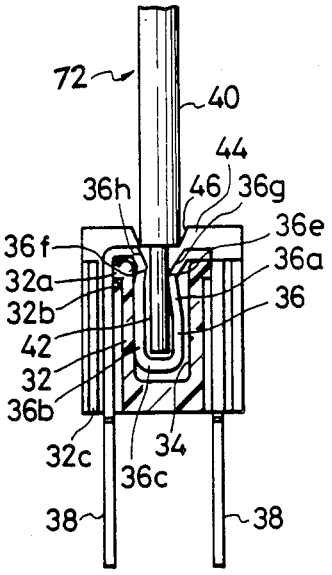
FIG. 3 is a cross-sectional view of the connector assembly shown in FIG. 2.

Referring to FIG. 3, it is seen that the U-shaped terminal 36 includes a pair of side arms 36*a*, 36*b* separated from one another by means of integral bridge portion 36*c*. Near the open upper end of cavity 36*a*, there is formed an opposing pair of protruding contact portions 36*e*, 36*f* integrally with each side arm 36*a*, 36*b*, respectively. Contact portions 36*e*, 36*f* thus define therebetween an entranceway of reduced cross-sectional dimension which serves to create contact with the exposed end portion 42 of cable 72 when the former is inserted into cavity 34. To facilitate insertion of the exposed end portion 42 between contact portions 36*e*, 36*f*, there is preferably provided a downwardly and inwardly tapered guide surface 36*g*, 36*h* which terminates at the contact portions 36*e*, 36*f*, respectively.

Figure 1:
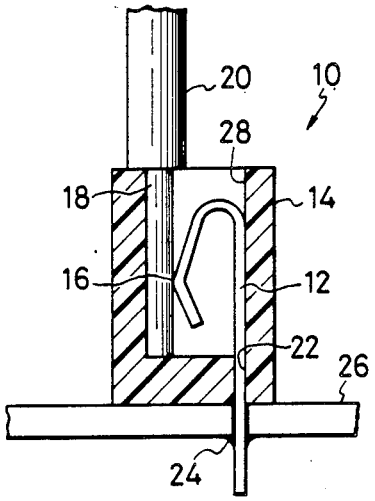
FIG. 1 PRIOR ART
FIG. 1 is a cross-sectional view of a conventional terminal connector assembly.

Each tail portion 38 is integrally connected to an upper end of side arm 36*b* such that the side arm 36*b* of tail portion 38 extends over the upper lip 32*a* of terminal block 32 and downwardly along an exterior side thereof. Rigid interconnection between tail portion 38 and terminal block 32 is preferably effected by means of a shim member 32*b* which wedges the tail portion 38 against flange 32*c*. By virtue of the rigid interconnection between tail portion 38 and terminal block 32, the other side arm 36*a* is free so as to exhibit a spring force tending to close the separation dimension between contact portions 36*e*, 36*f* while yet permitting side arm 36*a* to be displaced against the spring force upon insertion of exposed end 42 therebetween. Thus, when exposed end 42 is inserted between side arms 36*a*, 36*b*, the spring force provided as described above urges contact portion 36*e* into electrical contact with exposed end 42 which, in turn, causes exposed end 42 to be maintained in electrical contact with contact portion 36*f*. In such manner, reliable electrical contact is established with exposed end 42 thereby ensuring reliable electrical communication between the components to which cable 72 is connected and the substrate or printed circuit board (not shown) via tail portion 38. Since the tail portion 38 extends along an exterior side of the terminal block 32, the possibility of fluxing agents gaining entry into the cavities 34 is thus prevented thereby alleviating a significant disadvantage associated with conventional terminal connectors as was described previously with reference to FIG. 1.

Figure 4:
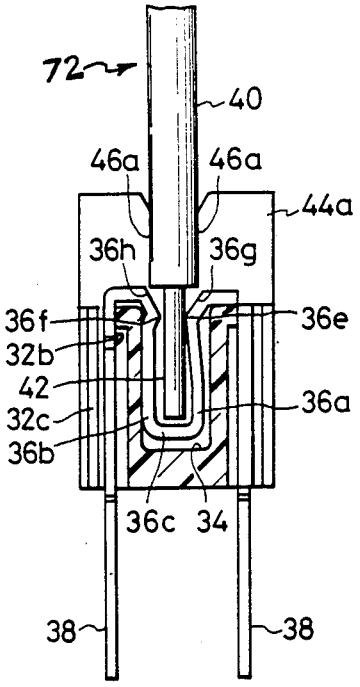
FIG. 4 is a modified version of the embodiment of the terminal connector assembly shown in FIGS. 2 and 3.

FIG. 4 shows one form of the partition wall 44*a* which is upwardly extended to a greater extent than partition wall 44 shown in FIGS. 2 and 3. Partition wall 44*a* of FIG. 4 establishes a similar recess 46*a* having a width dimension which is substantially equal to the dimension of the insulation material 40 of multiconductor cable 72. Thus, by virtue of the length dimension of recess 46*a* (owing to the upward extension of partition wall 44*a*), greater axial support of cable 72 is provided which serves to absorb stresses exerted upon cable 72 (such as by bending or the like) thereby ensuring that the electrical contact between protruding contact portions 36*e* and 36*f* on the one hand and the exposed end portions 42 on the other hand is not deleteriously affected.

Figure 5:
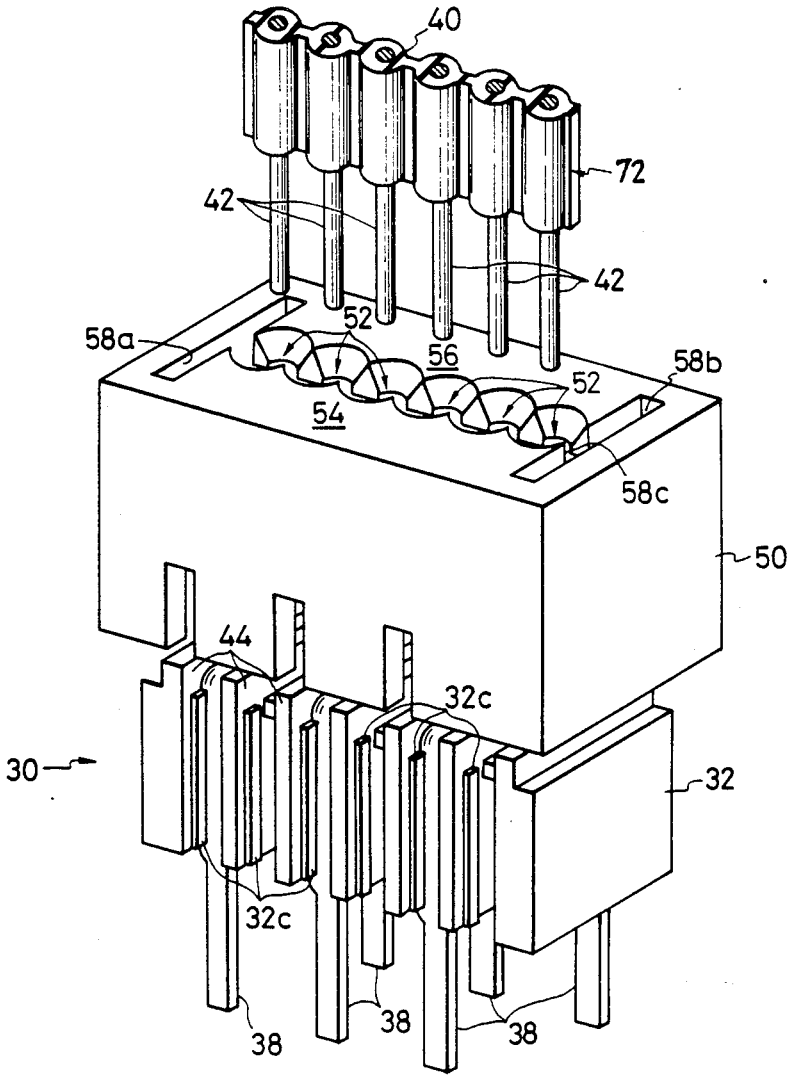
FIG. 5 is a perspective exploded view of the terminal connector assembly of the present invention and a cover housing therefor.
Figure 6A:
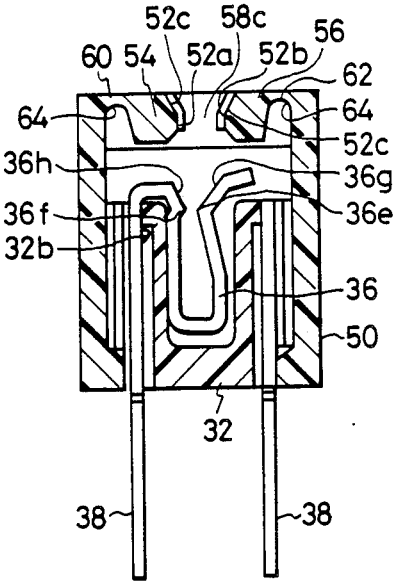
FIGS. 6A and 6B are each cross-sectional views of the terminal connector assembly/cover housing shown in FIG. 5 which particularly depict the manner in which a multiconductor cable is received therein.
Figure 6B:
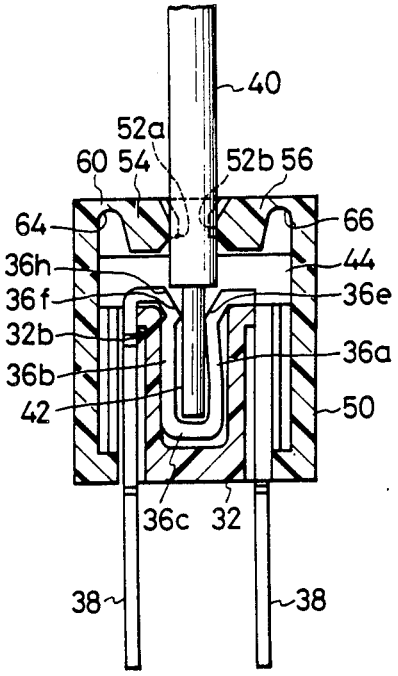

In a particularly preferred embodiment of the present invention, a housing cover 50 is connected to (and thus houses) terminal connector assembly 30 as will be described below with reference to FIGS. 5 and 6A–6B. As can be seen in FIG. 5, the housing 50 defines in its upper surface plural apertures 52 sized and configured to accept the cable 72 therein and which are in registry with the linear array of cavities 34 in terminal connector assembly 30. Apertures 52 are preferably defined by a pair of confronting aperture sections respectively defined on confronting forward edges of peninsular members 54, 56. The peninsular members 54, 56 are established by means of transverse grooves 58*a*, 58*b* and a central groove 58*c* connecting grooves 58*a*, 58*b* and passing generally through the center of each defined aperture 52. In such a manner, the apertures 52 are bifurcated so as to establish independent sections 52*a*, 52*b* thereof as can be seen more clearly in FIGS. 6A and 6B.

The peninsular members 54, 56 are each integrally connected to the housing 50 by means of integral hinge portions 60, 62, respectively. That is, upwardly extending recesses 64, 66 each provide for an area of reduced cross-sectional thickness to thereby establish (at the reduced thickness) the integral hinges 60, 62, respectively. Since the housing cover 50 is preferably a unitary member formed of a resin material, the peninsular portions 54, 56 are resiliently biased into the position shown in FIG. 6A whereby the dimension between sections 52*a*, 52*b* is a minimum. However, upon depression of either of the peninsular portions 54 or 56, sections 52*a* or 52*b* will be pivotally displaced about an axis established by hinge 60 or hinge 62, respectively, so as to widen the dimension between sections 52*a*, .52*b*. Thus, when cable 72 is inserted between sections 52*a*, 52*b* of apertures 52 (see FIG. 6B), the sections 52*a*, 52*b* will be grippingly pressed against the insulation 40 so as to retain cable 72 in position in terminal connector assembly. 30 to thereby assist in maintaining electrical contact of exposed end 42 between contact portions 36*e*, 36*f*. However, should it be desired to remove cable 32 from connector assembly 30, one need only depress either peninsular portion 54 or peninsular portion 56 as was discussed previously so as to widen the dimension between sections 52*a*, 52*b* of aperture 52 thereby releasing their gripped engagement with cable 72 to permit withdrawal of cable 72. Preferably, the sections 52*a*, 52*b* include upwardly and outwardly diverging concave surfaces 52*c*, 52*d* which serve as a tapered guideway into apertures 52.

Figure 7:
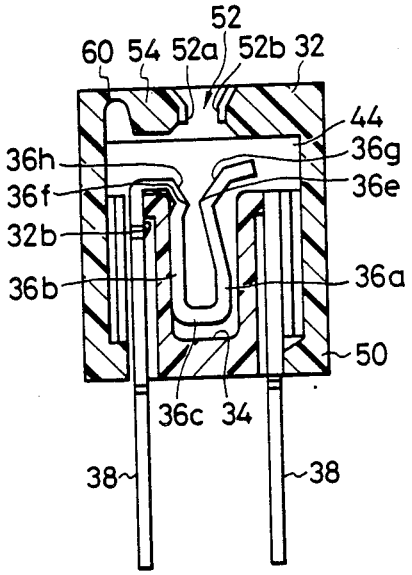
FIGS. 7–9 are each cross-sectional views of further embodiments of the terminal connector assembly/cover housing of the present invention.
Figure 8:
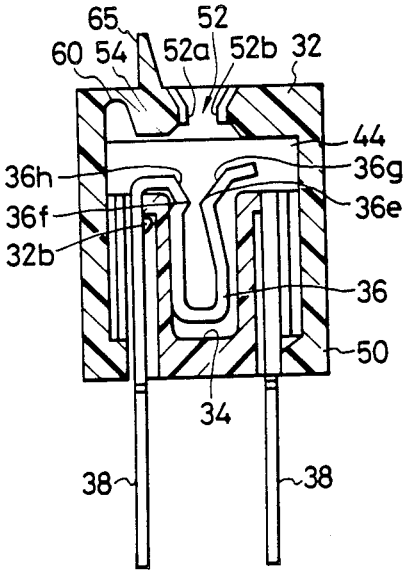
Figure 9:
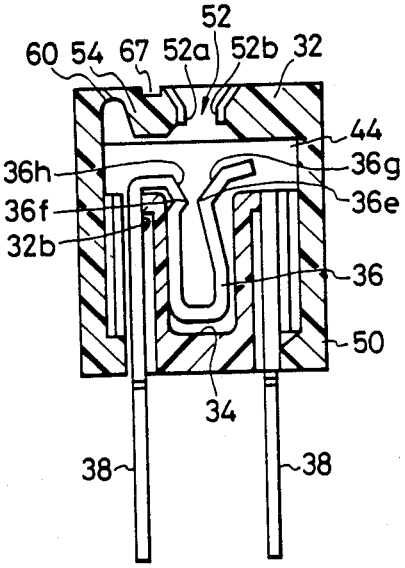

As shown in FIG. 7, a pair of peninsular portions 54, 56 as described previously with reference to FIGS. 5 and 6A–6B is not necessary in accordance with the present invention but rather only one peninsular portion 54 could be provided to achieve similar beneficial functions as described previously. Furthermore, as shown in FIGS. 8 and 9, an identifying protrusion 65 (see FIG. 8) or an identifying recess 67 could be provided on peninsular portion 54, for example, to identify that portion which is capable of being displaced upon manual depression by a user. In such a situation, protrusion 65 and recess 67 are each preferably disposed adjacent to the linear array of apertures 52 substantially parallel therewith.

While the present invention has been herein described in what is presently conceived to be the most preferred and exemplary embodiments thereof, those in this art may recognize that many modification could be made to the invention, which inventions are to be accorded the broadest scope of the appended claims so as to encompass all equivalent structures and/or assemblies thereof.

What is claimed is:

1. A terminal connector assembly for removably receiving end portions of a multiconductor cable thereby to establish electrical communication between said cable and a substrate member, said connector assembly comprising:

a terminal block defining an array of interior elongate cavities each having an open upper end, each said cavity including a generally U-shaped terminal member having a pair of opposing spaced-apart side arms and a bridge portion integrally connecting said pair of side arms, said bridge portion being located near a lower end of said cavity opposite to said upper end such that said pair of side arms extend upwardly to said open upper end to permit a respective one of said cable end portions to be insertably received between said pair of arms, said pair of arms integrally including an opposing pair of inwardly protruding contact portions which establish therebetween an entranceway of reduced cross-sectional dimension, said contact portions for contacting said end portion when said end portion is inserted between said pair of side arms thereby to establish electrical contact therewith;

said connector assembly also comprising a tail member electrically connected to one of said side arms and extending along and below an exterior side of said terminal block for connection to said substrate whereby electrical communication between said terminal end portion and said substrate is established.

2. A terminal connector assembly as in claim 1 wherein said cavities are arrayed in at least one row and wherein said terminal block includes plural upstanding partition walls each positioned between respective adjacent ones of said cavities.

3. A terminal connector assembly as in claim 2 wherein each said partition wall defines a recessed portion sized and configured to accept an insulated portion of said multiconductor cable to assist in retaining said end portions in electrical contact with said protruding end portions, as well as to prevent said contact portion from moving upon bending of said multiconductor cable.

4. A terminal connector assembly as in claim 1 further comprising a housing cover connected to said terminal block so as to cover the same, said housing cover comprising:

plural apertures formed in registry with said array of cavities; and release means for permitting resilient displacement of at least one section of each said aperture relative to another section of each said aperture such that said one section is resiliently displaceable between (i) a gripping position wherein said one and another sections establish therebetween a lesser aperture dimension such that said one and another sections grip an insulated portion of said cable to retain said end portion in electrical contact with said contact portions of said terminal members, and (ii) a release position wherein said one and another sections establish therebetween a greater aperture dimension such that said insulated portion is released thereby permitting said cable end portion to be withdrawn from said terminal block.

5. A terminal connector assembly as in claim 4 wherein said release means includes means defining at least one peninsular member and hinge means for integrally connecting said peninsular member at a rear portion thereof to said housing cover, said peninsular member having a forward edge to define said one section in opposition to said another section, said hinge means for permitting resilient pivotal displacement of said forward edge about an axis established by said rearward portion in response to manual depression of said peninsular member wherein said one section is displaced from said gripping position and into said release position.

6. A terminal connector assembly as in claim 5 wherein said hinge means biases, due to its inherent resiliency, said peninsular portion into said gripping position.

7. A terminal connector assembly as in claim 6 wherein said peninsular member near said forward edge includes means for identifying said peninsular member and for assisting a user in manually displacing said peninsular member.

8. A terminal connector assembly as in claim 7 wherein said means for identifying is a protrusion upwardly projecting from said peninsular member.

9. A terminal connector assembly as in claim 7 wherein said means for identifying is a recess positioned adjacently parallel to said plural apertures.

10. A terminal connector assembly as in claim 4 wherein said release means includes means defining a pair of opposing peninsular members each having hinge means for integrally connecting said member at respective rear portions thereof to said housing cover, said peninsular members each having a forward edge opposite said respective rear portion such that a forward edge of one said peninsular member defines said one section and a forward edge of the other said peninsular member defines said another section, said forward edges of said pair of peninsular members adjacently facing one another so that said one and another sections establish said apertures, said hinge means for permitting resilient pivotal displacement of said forward edges of said pair of peninsular members about an axis established by said forward portion in response to manual depression of said pair of peninsular members wherein said one and another sections are displaced relative to one another between said gripping and release positions.

* * * * *